US006155382A

United States Patent [19]

Duijnstee

[11] Patent Number: 6,155,382

[45] Date of Patent: Dec. 5, 2000

[54] RUNNING GEAR FOR A DRIVE MECHANISM FOR A RAIL-GUIDED DISPLACEMENT DEVICE

[75] Inventor: Eduard Jozef Marie Duijnstee, Ouderkerk aan den IJssel, Netherlands

[73] Assignee: Thyssen De Reus B.V., LN Krimpen Aan de IJssel, Netherlands

[21] Appl. No.: 09/051,030

[22] PCT Filed: Oct. 2, 1996

[86] PCT No.: PCT/NL96/00382

§ 371 Date: Jul. 2, 1998

§ 102(e) Date: Jul. 2, 1998

[87] PCT Pub. No.: WO97/12830

PCT Pub. Date: Apr. 10, 1997

[30] Foreign Application Priority Data

Oct. 2, 1995 [NL] Netherlands ..... 1001327

[51] Int. Cl.[7] ..... B66B 9/08

[52] U.S. Cl. ..... 187/200; 187/201; 187/245; 105/30

[58] Field of Search ..... 187/200, 201, 187/245; 105/30, 33, 153

[56] References Cited

U.S. PATENT DOCUMENTS

| | | | |
|---|---|---|---|
| 855,682 | 6/1907 | Wentworth | 105/33 |
| 3,056,359 | 10/1962 | Fey | 105/30 |
| 3,584,583 | 6/1971 | Cartwright | 105/30 |
| 4,260,869 | 4/1981 | Slavens et al. | 105/30 |
| 5,269,227 | 12/1993 | Warren et al. | 187/201 |

FOREIGN PATENT DOCUMENTS

| | | | |
|---|---|---|---|
| 0143737 | 6/1985 | European Pat. Off. . | |
| 000553764 | 8/1993 | European Pat. Off. | 105/30 |
| 1204095 | 11/1961 | France . | |
| 2168019 | 6/1986 | United Kingdom . | |
| WO 95/29867 | 11/1995 | WIPO . | |

*Primary Examiner*—Robert P. Olszewski
*Assistant Examiner*—Steven B. McAllister
*Attorney, Agent, or Firm*—Merchant & Gould P.C.

[57] ABSTRACT

A running gear (3), for a drive mechanism of a rail-guided displacement device, such as a passenger lift, comprising a base part, a drive and at least two sets of guide wheels (9), arranged behind each other, viewed in direction of travel of the running gear, so that, during use, the running gear is guided along the rail in a desired position by the guide wheels, the base part comprising at least a bridge piece (5), a first and a second frame part (6, 7), the frame parts each being connected to the bridge piece so as to be movable about at least one pivotal axis, each frame part carrying a set of guide wheels and the frame parts being mutually coupled by coupling means which form a mechanical mirror, so that the movements of the first and the second part are always each other's mirror image in a first plane of symmetry extending at right angles to the driving direction of the running gear between the first and the second frame part, and viewed relative to the bridge piece.

16 Claims, 7 Drawing Sheets

RUNNING GEAR FOR A DRIVE MECHANISM FOR A RAIL-GUIDED DISPLACEMENT DEVICE

BACKGROUND OF THE INVENTION

The invention relates to an assembly of a running rail and a running gear for the drive mechanism for a rail-guided displacement device, such as a stair lift. Such assembly is known from GB 2 168 019.

This known assembly comprises a running gear having a main frame and a pair of pivotable subframes, each of the subframes provided with guide wheels running on either side of the running rail. The subframes are each pivotable around an axis parallel to the axes of the guide wheels, extending perpendicular to the length of the running rails in the middle between said axis of said guide wheels. The facing sides of the subframes are provided with a curved surface having teeth, said teeth of said subframes meshing and providing for a mechanical mirror. Between the pairs of guide wheels on both subframes two further guide wheels are provided, positioned on both sides of the running rail. One of these further guide wheels is coupled to a pivotable rod which, through teeth and cooperating teeth on one of the subframes provides for pivoting of said subframe when running through a curve in a plane perpendicular to the axis of the guide wheels, which pivoting provides for the mirrored pivoting of the other subframe by means of the meshing teeth. Furthermore, a drive wheel is provided for movement of the running gear along said guide rails. The rotation axis of the drive wheel lies within the mirror plane between said subframes.

In this known running gear the chair is coupled to two flanges extending on either side of the running gear, in which bearings are provided for the pivoting axis of both subframes, as well as the axes of the pivoting member providing for the mirrored movements of said subframes. Therefore the chair follows the movements of the rotation axes of said subframes, which means that there will be movement of the chair relative to the drive wheel.

In using an assembly of this known type load carrying means will move in a direction perpendicular to the running rail, relative to the drive wheel when negotiating curves. Therefore, when the drive wheel is driven with a constant speed the chair is accelerated and decelerated when negotiating said curve, since the path of travel of the chair is either longer or shorter than the relative part of the guide track, depending on whether the curve is facing downward or upward. These accelerations and decelerations should be avoided for comfort of a passenger or other load and in order to keep the forces exerted on the running gear as low as possible.

This known assembly furthermore involves the drawback that when traversing a curve, the guide wheels will assume an undesired position relative to the running rail, because the position of the guide wheels relative to the rigid supporting part, made up of at least the two flanges and the axis of the guide wheels remains the same. In particular for guide wheels that do not lie in or parallel to the plane of the curve, this means that additional wear of the different parts such as wheel bearings and wheel tread occurs, because the axis of rotation of the relevant guide wheel is not at right angles to the tangent to the curve part in which the guide wheel is located. In other words, when traversing the curve, the tread of the wheel in question is always slightly oblique relative to the instantaneous line of movement to be travelled thereby. This applies to driven as well as to non-driven running gears of the known type.

A further assembly of the above-mentioned type is known from practice and is supplied by the firm of Thyssen de Reus, Krimpen aan de IJssel, the Netherlands.

The known running gear consists of a profiled guide rail along which a displacement device in the form of a lift for with the invention, a running gear is characterized in that the swivel axle of each frame part is spaced from a rotary shaft plane of said each frame part, said rotary shaft plane defined by at least two rotary shafts of respectively the set of guide wheels associated with each said frame part, the bridge piece including the third set of guide wheels which lie approximately in the plane of symmetry (S) and which, during use, have a supporting function, and the bridge piece having fastening means for a load to be carried drive wheel included in the running gear and a gear rack provided on the running rail. To ensure that the drive wheel remains in contact with the gear rack, a set of guide wheels is provided on both sides of the rail and on both sides of the drive wheel. The guide wheels are rotatable about shafts that fixedly connected to a supporting part, which supporting part moreover carries the drive wheel and a drive motor, if any.

The rigid supporting part of this known running gear has the advantage that thus a proper contact between the gear rack and the drive wheel is obtained and maintained, at least in the case of a relatively straight or only slightly bent running rail. When sharper curves are traversed, such a device has the drawback that the guide wheels should have a play such that they can move along both on the outside and on the inside of the curve without the drive wheel either moving away too far from the running rail, if the drive wheel is located on the inside of the curve in the running rail, or being pressed too tightly against the running rail or the gear rack, if the drive wheel is located on the outside of the curve. In the first case, the contact between the drive wheel and the gear rack will get lost, in the second case the drive wheel may seize and/or damage may be caused to the drive wheel and the gear rack. This problem can slightly be overcome by shortening the distance between the guide wheels on both sides of the drive wheel, but this affects the stability of the running gear adversely, which is undesirable, in particular in the case of, for instance, passenger lifts, which require that the user's safety be guaranteed at all times.

It has already been proposed to position the guide wheels on both sides of the running rail further apart than the width of the intermediate running rail. Although this enables a curve to be traversed more properly, it will also involve instability of the running gear, and, accordingly, of the stair lift, because at least in a straight running rail portion, the guide wheels then no longer abut against the running rail. Hence, for safety reasons, such an embodiment is less suitable.

SUMMARY OF THE INVENTION

The object of the present invention is to provide an assembly of the type described in the preamble of the main claim, with the drawbacks mentioned being avoided, while the advantages thereof are retained. To that end, in accordance with the invention, an assembly is characterized by the features of the characterizing part of claim 1.

In this context, a mechanical mirror can be interpreted as a coupling mechanism providing that the movement of a first part effects, in a mechanical manner, a movement of a second part coupled thereto, the movements of the first and the second part always being each other's mirror image in a plane of symmetry. This plane of symmetry is in a plane lying between the first and the second part. The position of the plane of symmetry at right angles to the driving direction of the running gear can be understood to mean that the direction of movement of the running gear at the location of the plane of symmetry extends at least substantially as a normal to the relevant plane of symmetry.

A running gear according to the invention offers the advantage that the sets of guide wheels can move relative to each other so that to each set of guide wheels it applies that the plane in which the axes of the relevant guide wheels are located intersects the running rail at right angles, i.e. each guide wheel of the running gear can continuously be held in such a position relative to the running rail that the tread thereof is located parallel to a tangent to the relevant part of the curve, so that when a curve is being traversed, each running wheel can move through that curve while rolling in an optimum manner, without making a combined rolling and dragging, dribbling movement. Moreover, a running gear according to the invention offers the advantage that each movement of one of the frame parts is mirrored by the frame part following or preceding it. As a result, when for instance a curve is run into or traversed, the position of the relevant frame part is adjusted by the leading guide wheels, so that the guide wheels practically follow the ideal line. By the coupling means, the position of the or each other frame part is adjusted to the curve to be traversed, as a result of which the guide wheels of this frame part, too, follow the ideal line. In this respect, the division into a number of frame parts has the advantage that the running gear can be guided through a relatively sharp curve without causing problems with the guide wheels, while the sets of guide wheels can have a relatively large mutual distance, so that a proper stability of the running gear is maintained.

In an advantageous embodiment, a running gear according to the invention is characterized in that the drive means include a drive wheel capable of cooperating with a fixedly disposed drive track. Preferably, the axis of rotation of the drive wheel extends approximately in the plane of symmetry.

Because of the arrangement of a drive wheel with an axis of rotation located in the plane of symmetry, the distance between the drive wheel and the running rail is fixed at all times, because in this arrangement, the drive wheel, like the guide wheels, follows a path having a bend radius whose momentary center always coincides with the center of the curve that is momentarily traversed. Consequently, the distance between the drive wheel and the running rail almost does not change during use, regardless of the relative position of the dive wheel in respect of the running rail. This means that in a particularly simple manner, a drive track can be fitted with which the drive wheel can cooperate. The drive track can for instance be approximately identical in form to the form of the path described by the running rail.

Preferably, the drive track is fixedly connected to the running rail.

In further elaboration, a running gear according to the invention is further characterized in that the coupling means are constructed so that the mechanical mirror functions three-dimensionally.

A mechanical mirror that functions three-dimensionally offers the advantage that the running gear can thus be guided over running rails containing double-curved curves. For instance, a running rail along the inside of a curve in a stair, with the stair direction changing and, moreover, the stair sloping.

The invention are further characterized in that to each frame part it applies that the rotary shaft plane of two adjacent frame parts and the plane of symmetry intersect in a line extending through approximately the center of a bend part of the guide rail in or near which bend part at least the two frame parts are located.

Preferably, the drive means include a drive wheel which is fixedly connected to the bridge piece, said bridge piece being connected, via bearings, to the frame parts, said bearings defining at least one pivotal or rotary axis between the relevant frame part and the bridge piece parallel to the plane of symmetry located between the relevant frame parts. In a preferred embodiment, the bearings include cardan joints or ball joints. Preferably, the bridge piece includes a set of guide wheels which, during use, have a supporting function. The bridge piece preferably includes fastening means for carrying a load.

A preferred embodiment is characterized in that at least for frame parts disposed straight side by side, the distance between the plane of symmetry and the bearings approximately corresponds to half the distance between the relevant plane of symmetry and said rotary shaft planes claims 6–10.

In a first particularly advantageous embodiment, a running gear according to the invention, in particular the coupling means thereof, is characterized in that the coupling means include a pin and a bowl-shaped recess, the recess being provided in a second frame part, in a side facing the first frame part, and the pin extending from the first frame part into the recess the part of the pin which extends into the recess and the recess being shaped so that the pin is movable in the recess along the walls thereof when the running gear traverses a bend.

By constructing the coupling means as a pin and a bowl-shaped recess cooperating therewith, a particularly simple, direct-acting and virtually true mechanical mirror is obtained. Such a construction can be manufactured and maintained in a relatively cheap manner.

In a second particularly advantageous embodiment, a running gear according to the invention, in particular the coupling means thereof, is characterized in that the coupling means include two disk parts and four coupling bars, two frame parts lying side by side each including a disk part, each disk part being connected adjacent a coupling point by means of a ball joint to an end of a first coupling bar which keeps the disk parts at least partly at a fixed mutual distance. At a distance from the coupling point and regularly spaced apart, three second coupling bars are connected, via flexible couplings, to the disk parts, each second coupling bar has a bent part, so that when the two disk parts lie parallel to each other, the flexible coupling adjacent a first end of a second coupling bar is connected to the first disk part in a position rotated through an angle of 180° relative to the position wherein the flexible coupling adjacent the opposite second end of same second coupling bar is connected to the second disk part.

In this embodiment, it is provided that when a curve is being traversed, the coupling means do not extend beyond the contours of the running gear, or at least of the frame parts. After all, in this embodiment, the outer second coupling bars define an approximately cylindrical space, within which space the entire coupling means remain in this embodiment, also during deformation thereof when a curve is being traversed.

Alternative embodiments of a running gear according to the invention, in particular the coupling means thereof, are characterized in that the coupling means include at least two intermeshing toothed parts, each toothed part having a surface provided with teeth that are curved in at least one direction. Preferably, the coupling means include at least one motor controlling one of the frame parts on the basis of the position or changes of position of the or each other frame part.

The invention further relates to a lift assembly comprising a supporting part such as a chair or platform, a running rail and a running gear according to the invention.

In an advantageous embodiment, such a lift assembly is characterized in that the running rail has a substantially circular section, the carrying part being carried via the running gear on one running rail.

By utilizing a single running rail on which the running gear is borne, which running rail has a substantially circular section, the running rail can be manufactured and fitted in a particularly simple manner, also in the case of, for instance, stairs having a steep course and/or short curves.

To explain the invention, exemplary embodiments of a running gear will hereinafter be described, with reference to the accompanying drawings, wherein:

DETAILED DESCRIPTION OF THE PREFERRED EMBODIMENT

Figure 1:
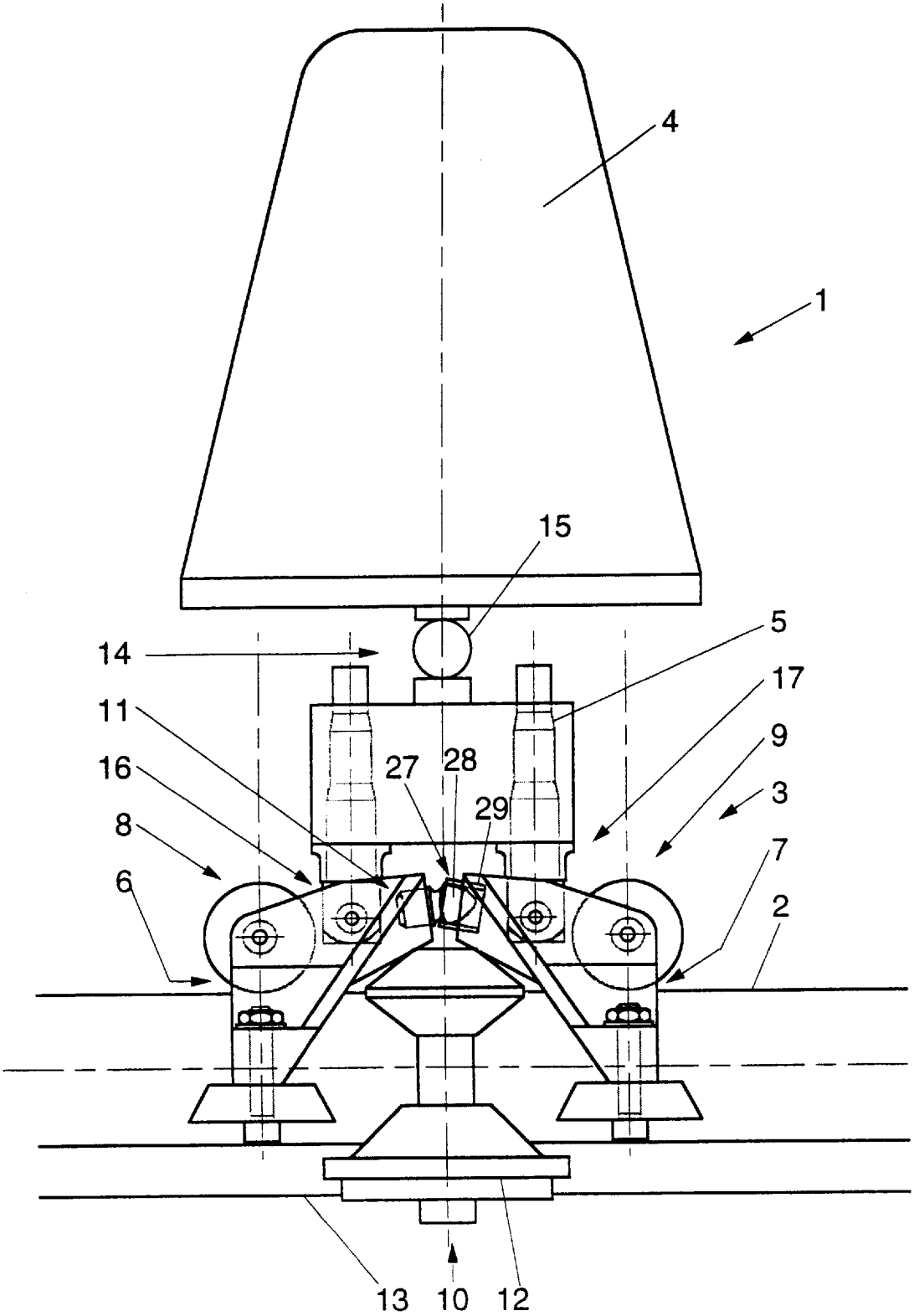
FIG. 1 schematically shows an embodiment of a stair lift comprising a running gear according to the invention.

FIG. 1 shows, in front view, a portion of a stair lift 1, positioned on a running rail 2 by means of a running gear 3. The running rail 2 for instance extends along the inside of a curved stair, i.e. that side of the stair which has the shortest bend radiuses. Hence, the running gear 3 should be capable of moving through relatively short curves while a flowing pattern of movement of the stair lift 1 should nevertheless be guaranteed and, moreover, the chair 4 or platform or any other supporting means thereof should continuously be held in the desired straight position, for instance by a tilting mechanism 15, not further described. For that purpose, it is necessary that the position of at least the running gear 3 relative to the running rail 2 be known. An advantage of only one running rail 2 instead of the conventional dual running rails is that this single running rail 2 is easier to manufacture, in particular when a running rail of a substantially circular section is opted for. Moreover, by such a stair lift, considerably less space is occupied than by a conventional stair lift having two rails, while further, the advantage is achieved that the stair lift can be provided on that side of the stair that is not or only minimally used by users of the stair who are not dependent on the stair lift 1, so that these users of the stair are not or only minimally hindered by the stair lift.

The running gear 3 comprises a bridge piece 5, a first frame part 6, a second frame part 7, a first set of guide wheels 8, a second set of guide wheels 9, a third set of guide wheels 10 and a coupling device 11. The third set of guide wheels 10 comprises a toothed drive wheel 12 engaging a gear rack 13 provided on the running rail 2. In FIG. 1, this third set of guide wheels is shown only schematically and will be further discussed hereinbelow. The bridge piece 5 comprises means 14 for supporting a load, for instance a tilting mechanism 15. These load-bearing means can for instance comprise a chair, platform, hook or another supporting means. For simplicity's sake, an embodiment of a stair lift with chair is shown.

The first frame part 6 is connected to the bridge piece 5 via a first cardan suspension 16, the second frame part 7 is connected thereto via a second cardan suspension 17. The first cardan suspension 16 comprises a first frame swivel axle 19 in the first frame part 6 which, in FIGS. 1 and 2, extends perpendicularly to the plane of the drawing and is connected, via a first frame rotary shaft 20, to the bridge piece 5. Preferably, the first frame swivel axle 19 and the first frame rotary shaft 20 intersect perpendicularly, with the first frame rotary shaft 20 in FIG. 1 lying in the plane of the drawing. Similarly, the second frame part 7 is connected, via a second frame swivel axle 21 and a second frame rotary shaft 23, to the bridge piece 5. Each frame part 6, 7 can move three-dimensionally relative to the bridge piece by means of the relevant cardan suspension 16, 17.

Figure 3A:
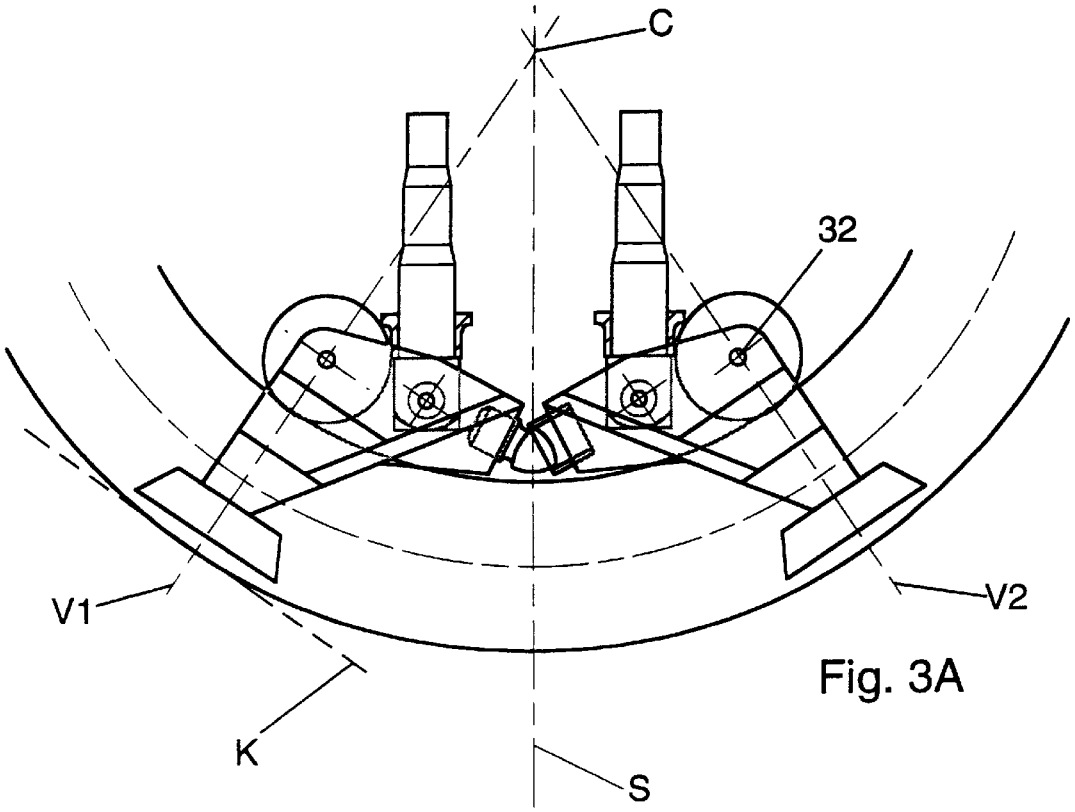
FIG. 3A schematically shows, in side elevation, a running gear according to FIG. 2, on a concave-curved running rail with third set of guide wheels taken, drive wheel and bridge piece taken away.
Figure 3B:
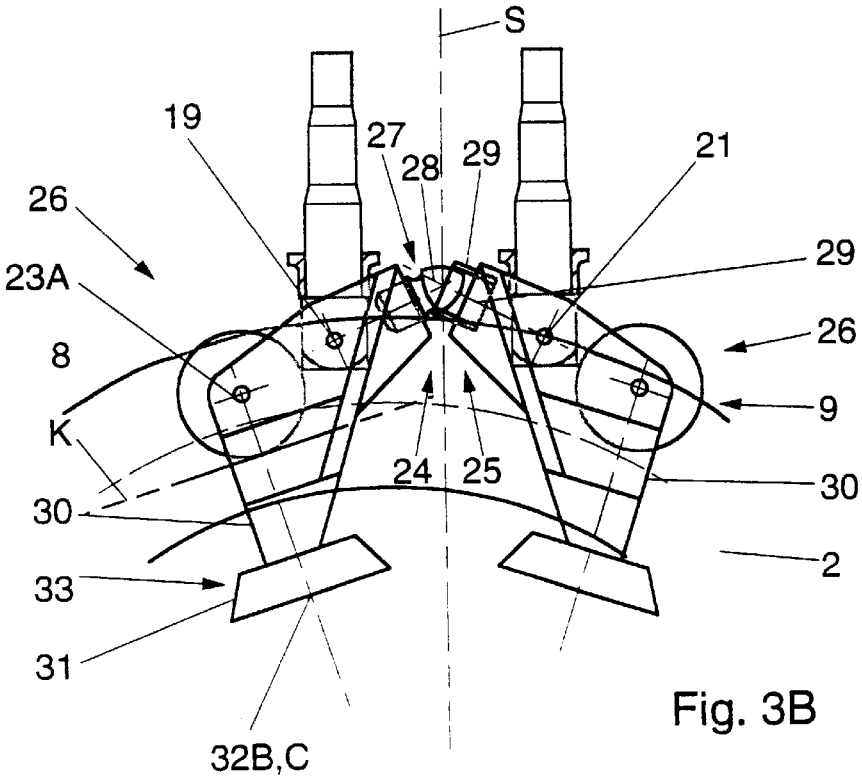
FIG. 3B schematically shows, in side elevation, a running gear according to FIG. 2, on a convex-curved running rail with third set of guide wheels, drive wheel and bridge piece taken away.

The facing ends 24, 25 (FIGS. 3, 4) of the frame parts 6, 7 are coupled to each other by the coupling means 11, which form a mechanical mirror. In this connection, a mechanical mirror can be interpreted as a coupling mechanism ensuring that the movement of the first frame part 6 effects, in a mechanical manner, a movement of the second frame part 7 coupled thereto, the movements of the first 6 and second frame part 7 always being each other's mirror image in the plane of symmetry S lying between the two frame parts 6, 7. This applies to substantially all movements of the two frame parts 6, 7 with a movement component in a direction parallel to the plane of symmetry S.

The coupling means 11 as shown in FIGS. 1–5 comprise a pin 27 extending from the end 24 of the first frame part 6 and having a slightly convex head 28, and a recess 29 provided in the end 25 of the second frame part 7, which end 25 faces the end 24 of the first frame part 6. The pin 27 extends into the recess 29 at least by the head 28 thereof, the head 28 having a portion of its surface abutting against the inside surface of the recess 29.

Adjacent the second end 26A located opposite the first end 24 of the first frame part 6, on the side thereof facing away from the bridge piece 5, the first set of guide wheels 8 is connected thereto via a bracket 30 or a like construction. In a similar manner, the second set of guide wheels 9 is connected to the second end 26B facing away from the first end of the second frame part 7. Each set 8, 9 comprises three spaced-apart wheels, rotatably mounted on rotary shafts 32*a*, 32*b*, 32*c*, so that the wheels 31 have their treads 33 abutting against the outside of the running rail 2. In each case, the rotary shafts 32*a–c* enclose an approximately perpendicular angle with a tangent K to the running rail 2 at the location of the contact surface between the running rail 2 and the tread 33 of the relevant guide wheel 31. As appears in particular from FIG. 5, the running rail 2 has a circular section, with the guide wheels 31 of each set 8, 9 being staggered about 120° relative to each other, so that the running rail 2 is effectively enclosed between the guide wheels 31 of each set 8, 9, while the guide wheels 31 can move rollingly across the surface of the running rail 2.

Figure 4A:
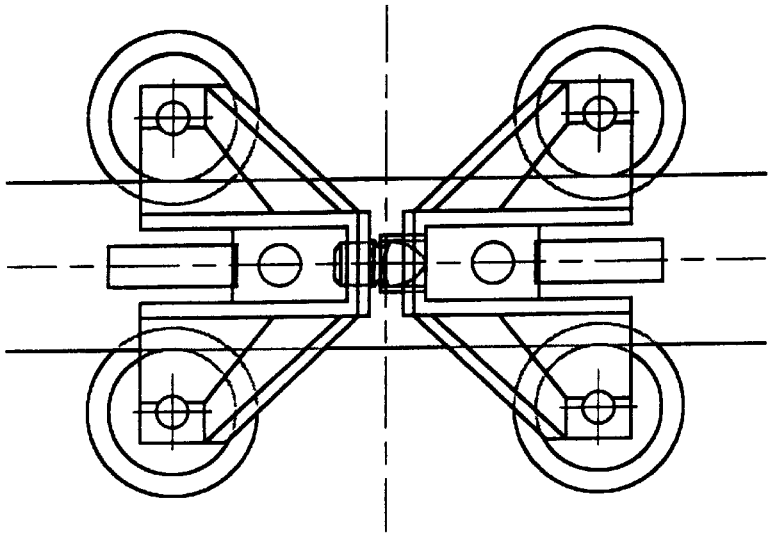
FIG. 4A schematically shows, in top plan view, a running gear according to FIGS. 2 and 3, on a straight running rail with third set of guide wheels, drive wheel and bridge piece taken away.
Figure 4B:
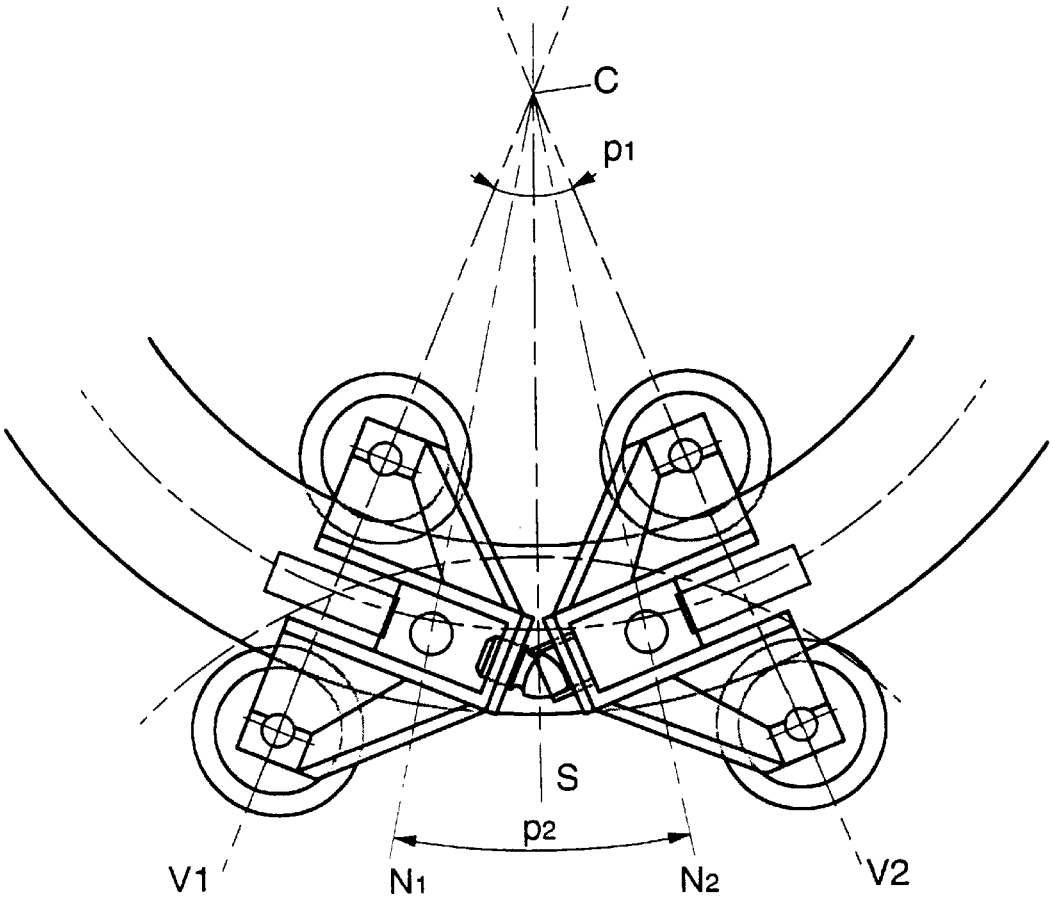
FIG. 4B schematically shows, in top plan view, a running gear according to FIGS. 2 and 3, on a curved running rail with third set of guide wheels, drive wheel and bridge piece taken away.

By at least two of the rotary shafts 32*a–c* of each set, a first plane $V_1$, $V_2$ is defined (FIGS. 2–4) which continuously extends approximately at right angles to each tangent K to the running rail 2 at the location of the contact surfaces between the relevant guide wheels 31 and the running rail 2. Preferably, the distance P between the first 19 and the second frame swivel axle 21, respectively the first 20 and the second frame rotary shaft 23, is equal to half the distance D between the first rotary shaft planes $V_1$, $V_2$. Also to the angle P enclosed between the rotary shaft planes $V_1$ and $V_2$, it applies that it is twice the angle $P_2$ enclosed between the imaginary lines $N_1$ and $N_2$ extending from the center C of the bend momentarily traversed by the running gear, through the axes of rotation 19 and 21 respectively (FIGS. 3A, 3B) or the axes of rotation 20 and 23 respectively (FIGS. 4A, 4B). Accordingly, a movement of the first end of each frame part 6, 7 (or at least at the plane of symmetry S) results in an equally great but opposite movement of the opposite end of the relevant frame part 6, 7 (or at least at the relevant set of guide wheels 8, 9), relative to the bridge piece 5. Because of the coupling of the two frame parts 6, 7 by means of the coupling means 26, the movements of the first end 24 of the first frame part 6 are imposed on the first end 25 of the second frame part and vice versa, mirrored relative to the plane of symmetry S. In the embodiment shown, this applies three-dimensionally.

Figure 5:
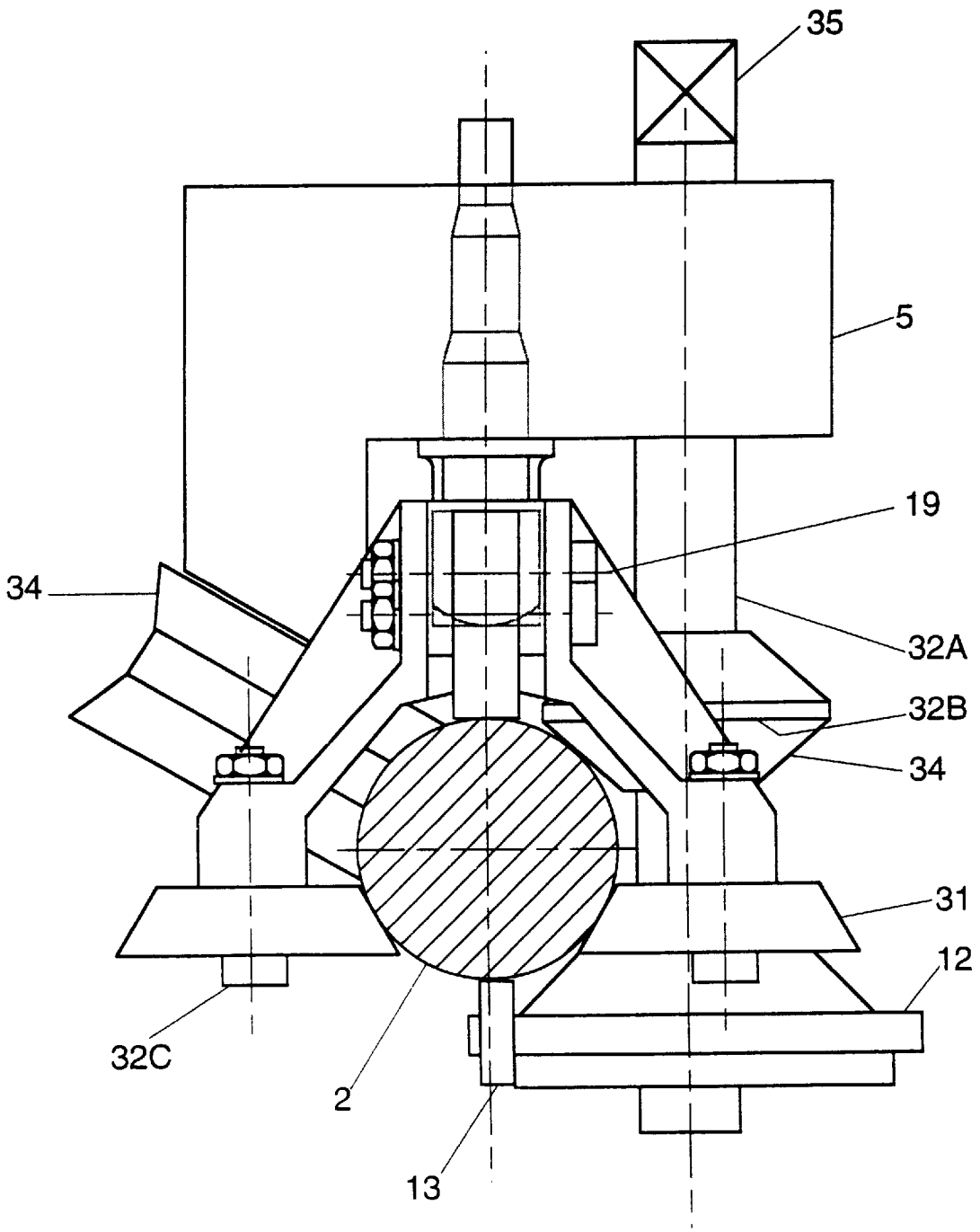
FIG. 5 schematically shows, in front view, a running gear according to FIG. 1, with cut-through running rail.

The third set of guide wheels 10 is fixedly connected to the bridge piece 5 and comprises at least two running wheels 34 rolling against the running rail, for instance by an hourglass-shaped or double conical tread, to save space. The third set 10 also comprises a drive wheel 12 constructed as gear wheel and capable of meshing with a gear rack 13 provided on the running rail (FIG. 5). Preferably, the axes of rotation of the running wheels 34 and the drive wheel 12 lie in the plane of symmetry S. The drive wheel 12 can be driven for moving the running gear along the running rail 2, for instance by means of a motor 35 mounted on the bridge piece 5.

With reference to the drawings, the movements of a running gear according to the invention are further described as follows. For simplicity's sake, the behavior of the running gear is described only in a bend lying in a vertical plane, parallel to the plane of the drawing in FIGS. 2 and 3. However, it is understood (FIG. 4) that corresponding movements occur when a bend lying in one plane is traversed, so that particular advantages are achieved when a randomly bent running rail is traversed.

Figure 2:
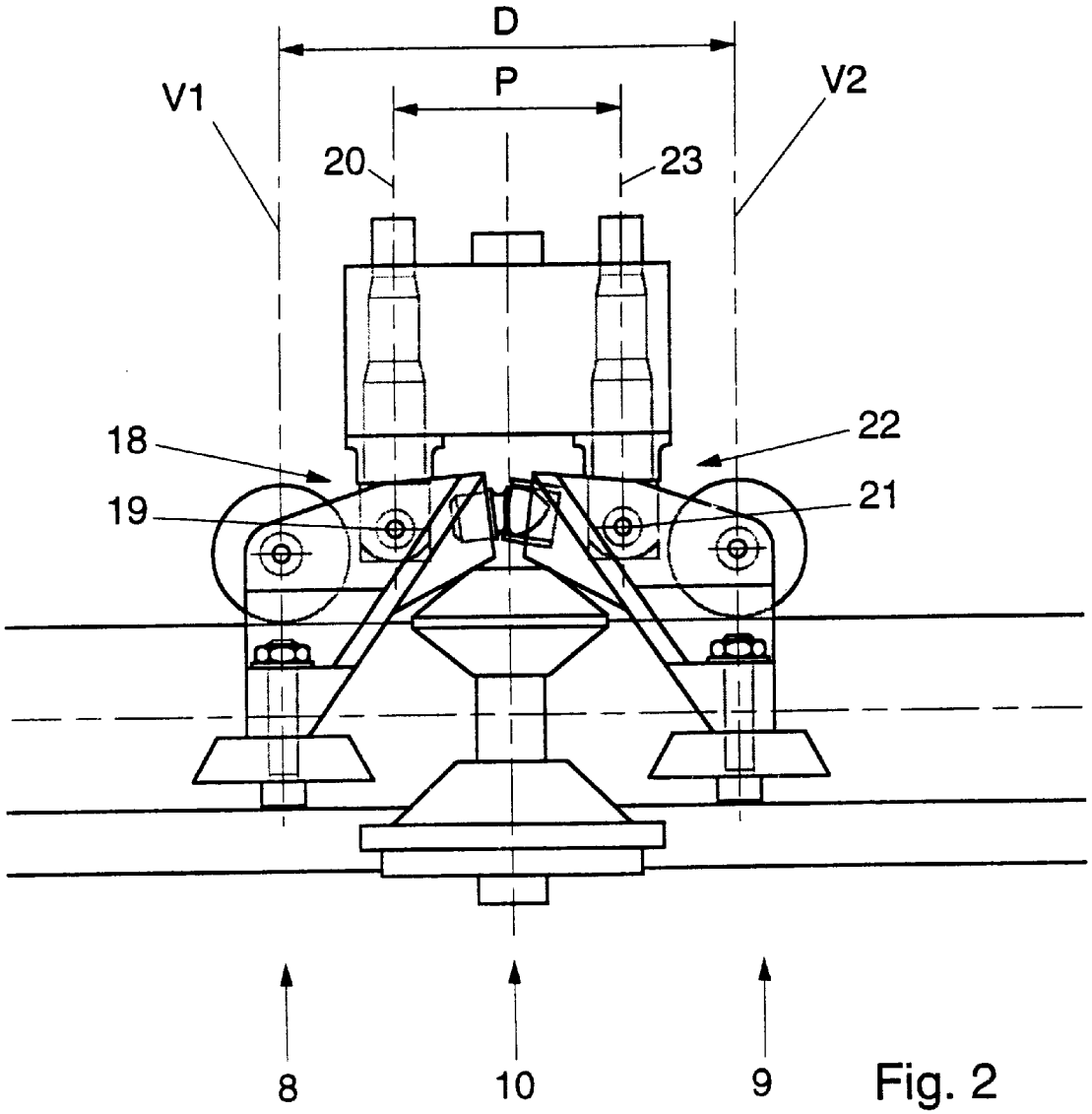
FIG. 2 schematically shows, in side elevation, a running gear according to the invention, on a straight running rail.

FIG. 2 shows the running gear 3 disposed on a straight portion of a running rail 2, i.e. with an endless bend radius. The first rotary shaft planes $V_1$ and $V_2$ and the plane of symmetry S extend parallel to each other. When moving through a bend in the running rail 2, the guide wheels 31 of the first set 8 with the second end 26 of the first frame part 6, relative to the bridge piece 5 and the third set 10 connected thereto, are urged in a direction of displacement, in FIG. 3A in upward direction. The lever action of the first frame part 6 around the first frame swivel axle 19 causes the opposite first end 24 to be pressed downwards through the same distance, with the head 28 of the pin 27 being pressed downwards as well. This head moves through a path of movement along the inside of the recess 29. As a consequence, the first end 25 of the second frame part 7 is pressed down as well, approximately through the same distance as the first end of the first frame part 6. The lever action of the second frame part 7 around the second frame swivel axle 21 causes the opposite second end 26 of the second frame part 7 to be pressed upwards, also through the same distance. Because the guide wheels 31 in the second set 9 fittingly enclose the running rail 2 and hence cannot move along upwards relative to the running rail, the vertical distance between the bottom side of the bridge piece 5 and the guide wheels is reduced.

When the running gear 3 is moved along the running rail 2, the two first rotary shaft planes $V_1$, $V_2$ and the plane of symmetry S will intersect in a line C extending through the center of the bow portion of the bend wherein the running gear 3 is located at that given moment (FIGS. 3 and 4). This means that the guide wheels 31 are continuously held in an optimum position relative to the running rail, which prevents the guide wheels 31, 34 from making a combined rolling and dragging, dribbling movement over the running rail or from moving around its own axis of rotation 32 in another manner different from rolling. Moreover, it is thus provided that the drive wheel 12 is always held in the same position relative to the center of the running rail 2, and accordingly relative to the gear rack 13. Thus, an optimally cooperating contact is provided between the drive wheel 12 and the tooth track of the gear rack 13 along the entire running rail, while the guide wheels 31, 34 can continuously be in optimum contact with the running rail 2 without requiring for instance setting means, springs or like compensating means.

Figure 6:
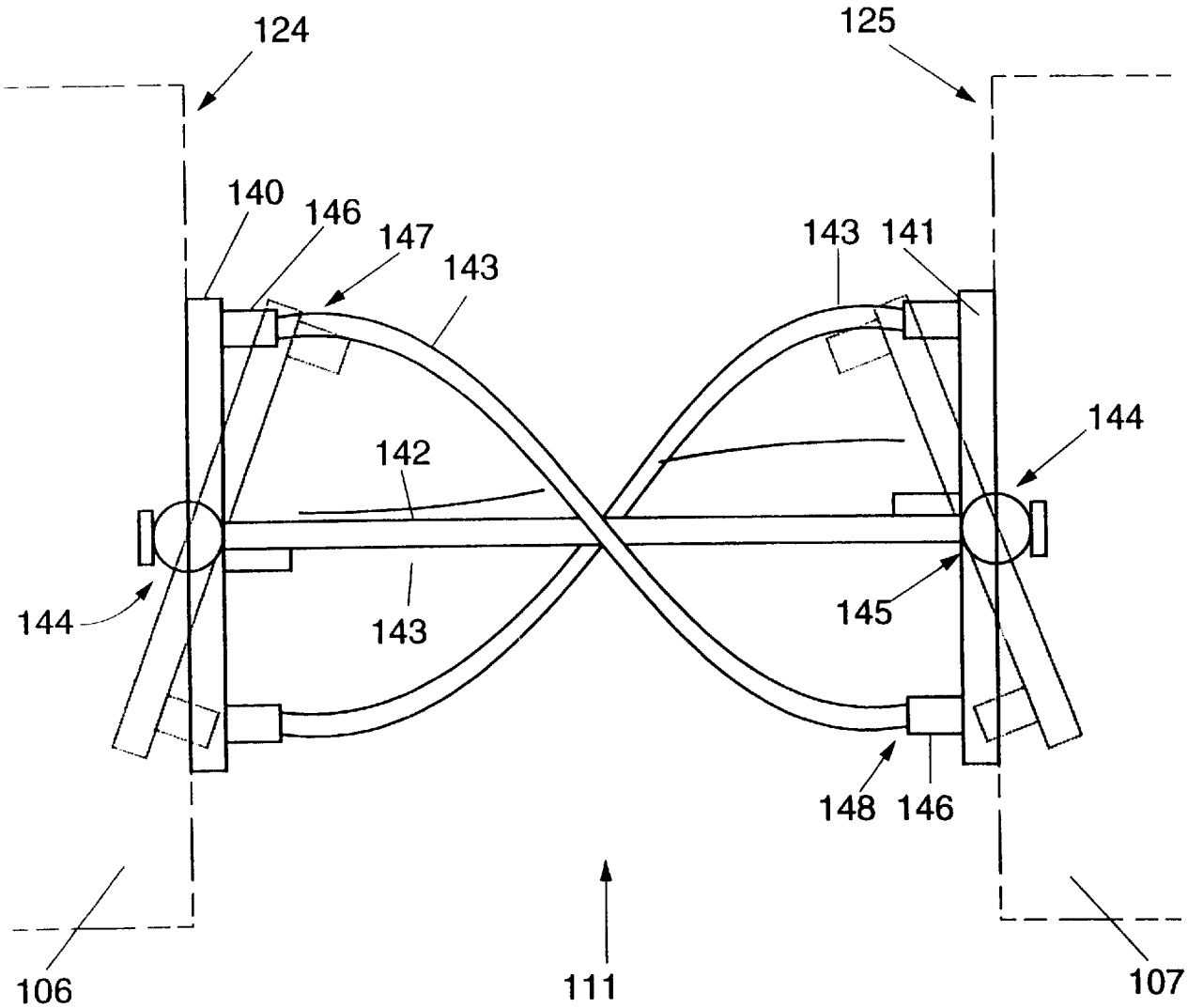
FIG. 6 schematically shows a first alternative embodiment of the coupling means.

FIG. 6 shows a first alternative embodiment for a three-dimensionally acting, mechanical mirror-forming coupling 111 for use in a running gear according to the invention. Identical parts are designated by corresponding reference numerals. This coupling according to FIG. 6 comprises a first annular disk 140, a second annular disk 141, a centrally located, straight first coupling bar 142 and three approximately similar, curved second coupling bars 143. The first disk 140 is mounted adjacent the first end 124 of the first frame part 106, the second disk 141 is mounted adjacent the first end 125 of the second frame part 107. In a centrally located coupling point 144, each disk 140, 141 is connected, by means of a ball joint, cardan suspension or a like connection, to an end 145 of the first coupling bar 142, which keeps the disks 140, 141 at least partly at a fixed distance relative to each other. Spaced from the coupling point 144, the three second coupling bars 143, regularly spaced apart, are connected to the disks 140, 141 via flexible couplings 146. Each second coupling bar 143 has a part bent so that when the two disks 140, 141 lie parallel to each other, the flexible coupling 146 adjacent a first end 147 of a second coupling bar 143 is connected to the first disk 140 in a position rotated through an angle of about 180° relative to the position wherein the flexible coupling 146 adjacent the opposite second end 148 of the same second coupling bar 143 is connected to the second disk 141.

The functioning of such a coupling can be understood as follows.

The two disks 140, 141 cannot move relative to each other other than swivelling about the ball joints in the central coupling 144. Hence, they cannot move towards or from each other vertically. For instance, if the first disk 140 is swivelled from the vertical position as shown in FIG. 6 into the position shown in broken lines, the first end 147 of the relevant second coupling bar 143, which first end 147 is located above the first coupling bar 142, is pressed in the direction of the opposite second disk 141, with the relevant second coupling bar 143 being displaced as a whole. As a result, the second end 148 of the relevant second coupling bar 143 is displaced through about the same distance as the first end. Of course, this applies to all second coupling bars 143. Because the second end 148 of each second coupling bar 143 is connected, via a flexible coupling 146, to the second disk 141 on a side of the central first coupling bar 140 other than the first end of the relevant second coupling bar 143 to the first disk 140, the second disk 141 is swivelled in a direction opposite to the direction of movement of the first disk, through the same angle. Thus, the movements of the first frame part 106 are automatically transferred in mirrored fashion to the second frame part 107.

An advantage of this embodiment is that during the movements of the first and second frame parts, the coupling bars remain at least substantially within the (imaginarily enclosed) space defined between the disk parts. This means that the coupling means do not swivel out further than the frame parts, which has advantages in terms of space utilization. Moreover, this prevent users of the displacement device from being inconvenienced by the coupling means, or prevents the functioning of the coupling means from being disturbed by the user.

Figure 7:
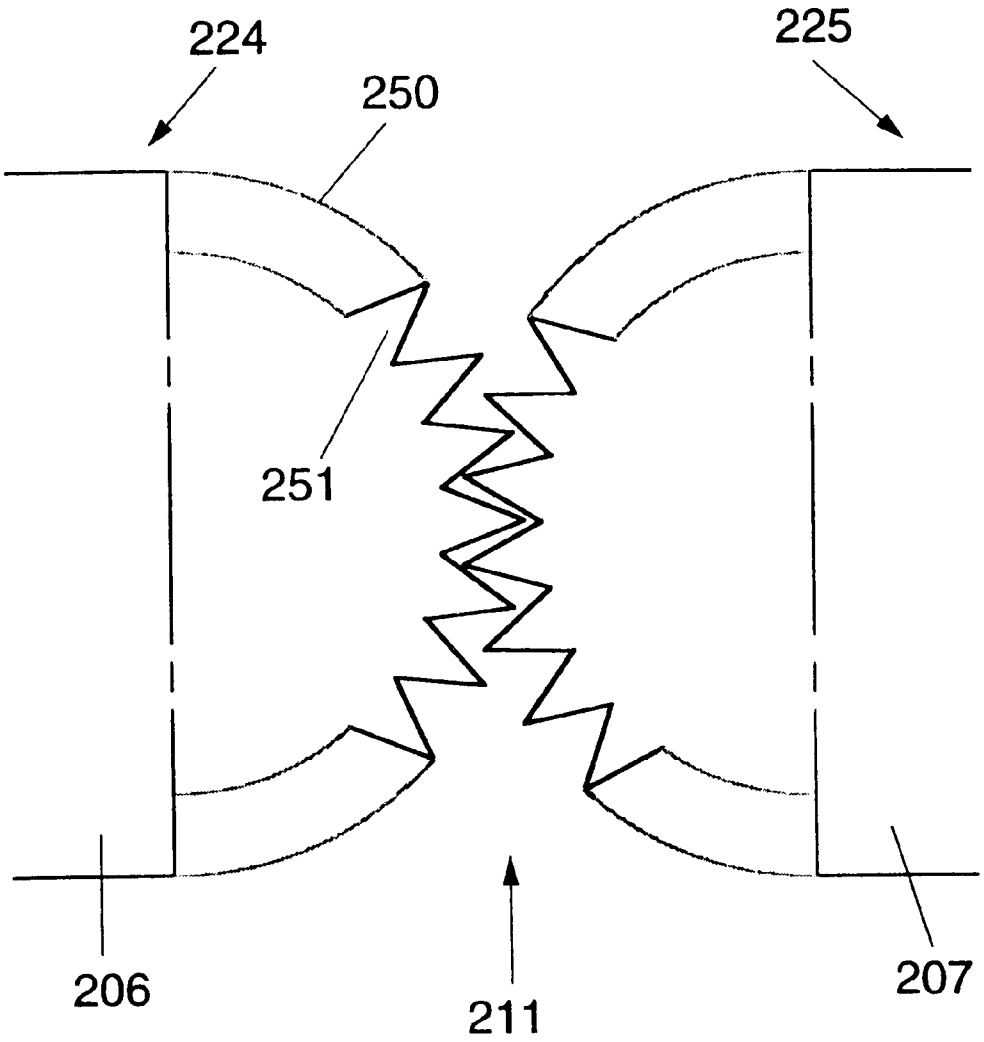
FIG. 7 schematically shows a second alternative embodiment of the coupling means.

FIG. 7 shows a second alternative embodiment of the coupling means for forming a mechanical mirror, in a two-dimensional embodiment. Corresponding parts are again designated by corresponding reference numerals.

Arranged on each of the first ends 224, 225 of the first frame part 206 and second frame part 207, which first ends lie adjacent each other, is a circular segment 250 provided, along the outer surface thereof, with a row of teeth 251. In this embodiment, the toothed circular segments 250 mesh with each other for transferring the movememnts of the first frame part 206 to the second frame part 207 and vice versa. In a three-dimensional embodiment constructed in a comparable manner (not shown), the circular segments have been replaced by spherical segments, provided with concentric rows of teeth along their outside surface.

The invention is by no means limited to the embodiments shown and described in the drawings and the specification. Many variations thereto are possible.

For instance, the running gear may have several mutually coupled frame parts, so that still shorter bends can be traversed without the occurrence of disturbances, while sufficient stability is maintained. The coupling means may be constructed in different manners. Moreover, a comparable running gear may be used in other types of running rails, for instance rails of a rectangular section, or with a number of running rails next to or above each other. In addition, the running rail may also extend in one plane only, while the mechanical mirror may be of two-dimensional construction, as described. The gear rack may for instance be welded on the outside against the running rail, be constructed as a series of holes in the running rail or be provided at a distance from the running rail. Moreover, other drive means may be used. For instance, the running gear may be provided, adjacent one of the ends thereof, with a drive gear which is connected thereto in a flexible manner and which is capable of guiding the running gear along the running rail through pushing or pulling action, or the drive means may for instance be mounted on one of the frame parts instead of on the bridge piece, and a drive wheel, if any, may have an axis of rotation which is at a different angle relative to the running rail, for instance horizontally, and several drive wheels may be used which may or may not be in different positions. Further, the running gear may be used for various uses other than the stair lift mentioned. These and many comparable adaptations and variations are understood to fall within the framework of the invention.

What is claimed is:

1. An assembly of a running rail and a running gear for a drive mechanism of a rail-guided displacement device, the assembly comprising:

a guide rail, a base part, drive means and at least a first, third and second set of guide wheels, arranged one behind the other, viewed in direction of travel of the running gear, so that, during use, the running gear is guided along the rail in a desired position by the guide wheels, the base part comprising at least a bridge piece, a first and a second frame part, the frame parts each being movably connected to the bridge piece via a swivel axle, each frame part carrying a set of guide wheels and the frame parts being mutually coupled by coupling means which form a mechanical mirror, so that the angular movements of the first and the second parts about any axis substantially perpendicular to the direction of travel are always each other's mirror image in a first plane of symmetry extending at right angles to the driving direction of the running gear between the first and the second frame part, viewed relative to the bridge piece, wherein the swivel axle of each frame part is spaced from a rotary shaft plane of said each frame part, said rotary shaft plane defined by at least two rotary shafts of respectively the set of guide wheels associated with each said frame part, the bridge piece comprising the third set of guide wheels which lie approximately in the plane of symmetry (S) and which, during use, have a supporting function, and the bridge piece comprising fastening means for a load to be carried.

2. The assembly of claim 1, wherein the drive means comprise a drive wheel capable of cooperating with a fixedly disposed drive track.

3. The assembly of claim 2, wherein the axis of rotation of the drive wheel extends approximately in the plane of symmetry.

4. The assembly of claim 3, wherein the drive track is fixedly connected to the running rail.

5. The assembly of claim 1, wherein the coupling means are constructed so that the mechanical mirror functions three-dimensionally.

6. The assembly of claim 1, characterized in that to each frame part it applies that the rotary shaft plane of two adjacent frame parts and the plane of symmetry intersect in a line extending through approximately the center of a bend part of the guide rail in or near which bend part at least the two frame parts are located.

7. The assembly of claim 1, wherein the drive means comprise a drive wheel which is fixedly connected to the bridge piece, said bridge piece being connected, via bearings, to the frame parts, said bearings defining at least one pivotal or rotary axis between the relevant frame part and the bridge piece parallel to the plane of symmetry located between the relevant frame parts.

8. The assembly of claim 7, wherein the bearings comprise cardan joints or ball joints.

9. The assembly of claim 7, wherein at least for frame parts disposed straight side by side, the distance between the plane of symmetry and the bearings approximately corresponds to half the distance between the relevant plane of symmetry and said rotary shaft planes.

10. The assembly of claim 7, wherein the bridge piece comprises a set of guide wheels which, during use, have a supporting function, the bridge piece comprising fastening means for a load to be carried.

11. The assembly of claim 1, wherein the coupling means comprise a pin and a bowl-shaped recess, the recess being provided in a second frame part, in a side facing the first frame part, and the pin extending from the first frame part into the recess, the part of the pin which extends into the recess and the recess being shaped so that the pin is movable in the recess along the walls thereof when the running gear traverses a bend.

12. The assembly of claim 1, wherein the coupling means comprise two disk parts and four coupling bars, two frame parts lying side by side each comprising a disk part, each disk part being connected adjacent a coupling point by means of a ball joint, to an end of a first coupling bar which keeps the disk parts at least partly at a fixed mutual distance, while at a distance from the coupling point and regularly spaced apart, three second coupling bars are connected, via flexible couplings, to the disk parts, each second coupling bar comprising a bent part, so that when the two disk parts lie parallel to each other, the flexible coupling adjacent a first end of a second coupling bar is connected to the first disk part in a position rotated through an angle of 180° relative to the position wherein the flexible coupling adjacent the opposite second end of same second coupling bar is connected to the second disk part.

13. The assembly of claim 1, wherein the coupling means comprise at least two intermeshing toothed parts, each toothed part having a surface provided with teeth that are curved in at least one direction.

14. The assembly of claim 1, wherein the coupling means comprise at least one motor controlling one of the frame parts on the basis of the position or changes of position of the or each other frame part.

15. A lift assembly, comprising a carrying part comprising a chair and an assembly of a running rail and a running gear for a drive mechanism of a rail-guided displacement device, the assembly comprising:

a guide rail, a base part, drive means and at least a first, third and second set of guide wheels, arranged one behind the other, viewed in direction of travel of the running gear, so that, during use, the running gear is guided along the rail in a desired position by the guide wheels, the base part comprising at least a bridge piece, a first and a second frame part, the frame parts each being movably connected to the bridge piece via a swivel axle, each frame part carrying a set of guide wheels and the frame parts being mutually coupled by coupling means which form a mechanical mirror, so that the angular movements of the first and the second parts about any axis substantially perpendicular to the direction of travel are always each other's mirror image in a first plane of symmetry extending at right angles to the driving direction of the running gear between the first and the second frame part, viewed relative to the bridge piece, wherein the swivel axle of each frame part is spaced from a rotary shaft plane of said each frame part, said rotary shaft plane defined by at least two rotary shafts of respectively the set of guide wheels associated with each said frame part, the bridge piece comprising the third set of guide wheels which lie approximately in the plane of symmetry and which, during use, have a supporting function, and the bridge piece comprising fastening means for a load to be carried.

16. The assembly of claim 15, wherein the running rail has a substantially circular section, the carrying part being carried via the running gear on one running rail.

* * * * *